US009834844B2

(12) United States Patent
Allcock et al.

(10) Patent No.: US 9,834,844 B2
(45) Date of Patent: Dec. 5, 2017

(54) NOZZLE FOR A THERMAL SPRAY GUN AND METHOD OF THERMAL SPRAYING

(75) Inventors: Bryan Allcock, North Shields (GB); Sai Gu, Sutton Fields (GB); Spyros Kamnis, Lamia (GR)

(73) Assignee: MONITOR COATINGS LIMITED (GB)

( * ) Notice: Subject to any disclaimer, the term of this patent is extended or adjusted under 35 U.S.C. 154(b) by 1100 days.

(21) Appl. No.: 13/258,984

(22) PCT Filed: Mar. 23, 2010

(86) PCT No.: PCT/GB2010/050482

§ 371 (c)(1), (2), (4) Date: Dec. 1, 2011

(87) PCT Pub. No.: WO2010/109223

PCT Pub. Date: Sep. 30, 2010

(65) Prior Publication Data

US 2012/0082797 A1 Apr. 5, 2012

(30) Foreign Application Priority Data

Mar. 23, 2009 (GB) ..... 0904948.7

(51) Int. Cl.
*B05B 7/16* (2006.01)
*C23C 24/04* (2006.01)
(Continued)

(52) U.S. Cl.
CPC ..... *C23C 24/04* (2013.01); *B05B 7/1486* (2013.01); *B05B 7/20* (2013.01); *C23C 4/129* (2016.01); *B05B 7/205* (2013.01)

(58) Field of Classification Search
CPC ..... B05B 7/1486; B05B 7/20; B05B 7/205; B05B 7/226; B05B 7/1495; B05B 7/203;
(Continued)

(56) References Cited

U.S. PATENT DOCUMENTS 4,275,841 A * 6/1981 Takeyama et al. ..... 239/431
4,830,279 A * 5/1989 Crum et al. ..... 239/3
(Continued)

FOREIGN PATENT DOCUMENTS

GB 1087088 A 10/1967
RU 2160640 C1 12/2000

OTHER PUBLICATIONS

International Search Report and Written Opinion received for corresponding PCT patent application No. PCT/GB2010/050482, mail date Sep. 1, 2010.

*Primary Examiner* — Alexander Valvis
(74) *Attorney, Agent, or Firm* — The Belles Group, P.C.

(57) ABSTRACT

A nozzle for a thermal spray gun and a method of thermal spraying are disclosed. The nozzle has a combustion chamber within which fuel is burned to produce a stream of combustion gases. The streams of heated gases exit through a pair of linear exhausts which are located on either side of an aerospike. The streams converge outside the nozzle and powdered coating material is introduced into the converging streams immediately downstream of the aerospike. The coating material is heated and accelerated before impacting on a substrate to be coated.

19 Claims, 11 Drawing Sheets

(51) Int. Cl.
*B05B 7/14* (2006.01)
*B05B 7/20* (2006.01)
*C23C 4/129* (2016.01)

(58) Field of Classification Search
CPC ... B05B 7/2429; B05B 7/2435; B05B 7/0416; B05B 7/0433; C23C 4/124; C23C 24/04; C23C 4/129
USPC ..... 239/79, 81, 85, 129, 592, 594, 595, 597, 239/568, 423, 424, 424.5; 427/421.1, 422
See application file for complete search history.

(56) References Cited

U.S. PATENT DOCUMENTS

| | | | | |
|---|---|---|---|---|
| 4,919,853 | A * | 4/1990 | Alvarez et al. | 264/12 |
| 4,958,767 | A * | 9/1990 | Labrot et al. | 239/13 |
| 5,545,031 | A * | 8/1996 | Joshi | F23D 14/22 239/424 |
| 5,996,904 | A * | 12/1999 | Smeraldi | A01M 7/0014 239/172 |
| 6,315,221 | B1 * | 11/2001 | Goenka et al. | 239/589 |
| 6,392,189 | B1 * | 5/2002 | Delcea | 219/121.5 |
| 6,669,106 | B2 * | 12/2003 | Delcea | 239/79 |
| 7,967,221 | B2 * | 6/2011 | Snyder et al. | 239/418 |
| 2004/0018317 | A1 | 1/2004 | Heinrich et al. | |
| 2007/0221746 | A1 * | 9/2007 | Heinrich et al. | 239/135 |

* cited by examiner

NOZZLE FOR A THERMAL SPRAY GUN AND METHOD OF THERMAL SPRAYING

CROSS-REFERENCE TO RELATED APPLICATIONS

This application is a National Stage entry from PCT Patent Application No. PCT/GB2010/050482 filed on 23 Mar. 2010, which claims priority to British Patent Application GB0904948.7 filed on 23 Mar. 2009. The contents of each of these applications is hereby incorporated by reference in its entirety.

BACKGROUND OF THE INVENTION

1. Field of the Invention

The present invention relates to a nozzle for a thermal spray gun and to a method of thermal spraying and relates particularly, but not exclusively, to a nozzle for a high velocity oxygen fuel (HVOF) thermal spray gun and method of HVOF thermal spraying.

2. Description of the Related Art

Techniques of thermal spraying, where a coating of heated or melted material is sprayed onto a surface, are well known. One such technique is high velocity oxygen fuel thermal spraying in which a powdered material, for example Tungsten Carbide Cobalt (WC—Co), is fed into a combustion gas flow produced by a spray gun and the heated particles accelerated towards a substrate that is to be coated. The powder is heated by the combustion of the fuel and oxygen mixture and accelerated through a convergent-divergent (Laval) nozzle.

Examples of HVOF thermal spray guns are disclosed in G. D. Power, E. B. Smith, T. J. Barber, L. M. Chiapetta UTRC Report No. 91-8, UTRC, East Hartford, Conn., 1991, Kamnis S and Gu S Chem. Eng. Sci. 61 5427-5439, 2006 and S. Kamnis and S. Gu Chem. Eng. Processing. 45 246-253, 2006. Nozzles from two such spray guns are shown in FIG. 1. The nozzle 10, of a HVOF spray gun, has a combustion chamber 12 into which a mixture of oxygen and fuel is injected through inlet 14 together with a powder that is to coat a substrate (not shown). Combustion of the fuel takes place in the combustion chamber and combustion gases expand and pass through a convergent-divergent restriction 16 and on through a barrel 18 before exiting through an exhaust 20.

Similarly, nozzle 22 has a combustion chamber 24 with various inlets 26 for fuel and oxygen and a convergent-divergent nozzle 28 with an extended divergent portion forming a barrel which contains an exhaust 30. The powder coating is introduced into the barrel as the divergence begins.

To avoid oxidation of the powdered material, heating must take place smoothly over a range of temperatures without exceeding a critical value. The temperature at which oxidation starts for most sprayed materials is well below the maximum flame temperature of around 3300K. For example, Tungsten Carbide Cobalt oxidation starts at a surface temperature of around 1500K. As a result, injection of the powder into the centre of the combustion chamber is not appropriate for this material and generally for non-ceramic materials and therefore the powdered material must be injected into the stream of supersonic gases. However, this gives the particles momentum in a radial direction making them likely to leave the gas stream before impacting on the article to be coated. Furthermore, bigger and heavier particles follow different trajectories compared to smaller, lighter ones. In practice, particle spreading reduces the spraying accuracy and decreases deposition efficiency because particle impact is not normal to the surface that is being coated.

Furthermore, injection of the powder into the nozzle results in damage to the nozzle, in particular erosion of the barrel's wall, and as a result the nozzle, or at least the barrel section, typically must be replaced every ten hours of operation.

When the rate of flow of combusted gases and powder particles accelerates to supersonic velocities, a series of expansion and compressions take place within the barrel. The gas stream in the interior expands and cools and is compressed and heats as it passes through the shock diamonds. The shock wave diamonds result in a loss of temperature and expansion on exiting the barrel increases the temperature loss. An overall decrease in static temperature (from around 3000K to around 2000K) and an overall increase in velocity (from around 200 m/s to around 1800 m/s) after compression and expansion in the convergent-divergent nozzle region, produces this behaviour inside the barrel. When the powder is injected into the high velocity gas stream, its dwell time is decreased due to an increased rate of acceleration. Therefore to ensure sufficient particle heating, a long barrel is required to maintain high gas temperatures. This long barrel, typically 350 mm, limits the applications to which the thermal sprayer can be applied, for example, internal surfaces of even quite large components are impossible to spray.

Small particles, below 10 μm, cannot practically be used because such small powdered material disperses in the gas field and consequently rebound from or never reach the article being sprayed. As a result, the small particles never reach the flow centre line and therefore cannot benefit from the high velocity/temperature flow regions. Instead they follow a route on the border of the free jet and when mixing with the ambient air outside the barrel starts, they diffuse in all directions. The lightweight particles are therefore chasing the flow direction and consequently are blown away from the substrate.

Preferred embodiments of the present invention seek to overcome the above described disadvantages of the prior art.

BRIEF SUMMARY OF THE INVENTION

According to an aspect of the present invention, there is provided a nozzle for a thermal spray gun, the nozzle comprising:

at least one combustion chamber having at least one fuel inlet for receiving at least one fuel, at least one combustion zone within which combustion of said at least one fuel takes place to produce a stream of combustion gases and at least one exhaust for exhausting said stream of combustion gases; and diverging means, located at least partially within said combustion chamber, for creating a divergence in said stream of combustion gases thereby creating a plurality of streams or an annular stream before converging to a single stream.

By creating a divergence in the stream of combustion gases, which then recombine into a single stream, a number of advantages are provided. Firstly, the nozzle of the present invention generates a more stable supersonic jet which reaches a higher axial velocity (around 2 mach) and is maintained for longer than in devices of the prior art under the same conditions of oxygen/fuel mixture and mass flow rate. The device of the present invention also reduces the trailing shock waves (diamond shock waves seen in the prior art jet) thereby reducing the loss of energy/temperature of the powder particles. This results in a single expansion of the flow, just after the tip of the diverging means, reducing the loss of energy. As a result, of the increased stability of the jet, the barrel portion of the nozzle is not necessary and can be eliminated. The overall length of the nozzle is therefore reduced allowing spraying of previously inaccessible surfaces, for example, internal surfaces of components.

Furthermore, because a divergence is created in the combustion gas stream, either producing two or more linear gas streams with the diverging means between them or an annular stream with the diverging means at the centre, the coating material can be introduced within the gap or divergence created in the stream by the divergence means. As a result, the coating material is never in contact with the fuel and oxygen mixture and is only in contact with the combusted gases once combustion is complete. As a result, the risk of oxidation of the coating material is reduced. This risk of oxidation is further reduced by the stability of the flame which increases the likelihood of oxygen from the surrounding air mixing with the stream of combusted gases and coating material.

Another factor allowing the elimination of the barrel is that the introduction of the powder immediately downstream of the diverging means results in the coating material being introduced into relatively slow moving but hot portion of the gas stream. As a result, in-flight time that the particle of coating material experiences, that is the time from introduction into the gas stream to deposition on the coated product, increases ensuring that each particle is properly heated. In some nozzles of the prior art, where particles are introduced into a fast flowing gas stream, there is little time for the particles to become sufficiently heated and the barrel is used to maintain the heat in the gas stream, before it begins to mix with the ambient air, to ensure sufficient heating of the particles.

In a preferred embodiment the diverging means further comprises at least one coating material inlet for introducing at least one coating material into said stream of said combustion gases.

In another preferred embodiment the coating material inlet comprises at least one aperture in said diverging means at a most downstream point of said diverging means in said stream.

By introducing the coating material on the downstream side of the diverging means, the advantage is provided that the coating particles do not pass through the nozzle and therefore do not come into contact with any part of the nozzle, such as a barrel. As a result, the heated particles do not damage the nozzle thereby extending the lifespan of a nozzle. Furthermore, because particles of coating material are being introduced into the middle of a stable stream of combustion gases the particles do not suffer much radial deflection meaning that they are more likely to remain within the gas stream. This in turn means that smaller particles of coating material (<10 μm) can be used for coating. Furthermore, the introduction of coating material into the middle of the stable and converging jet reduces waste from larger particle moving radially and missing their target.

In a preferred embodiment, the exhaust comprises a substantially annular aperture extending between said combustion chamber and said diverging means.

In another preferred embodiment, the exhaust comprises a plurality of substantially linear apertures extending between said combustion chamber and said diverging means.

In a further preferred embodiment, the diverging means extends at least partially outside said combustion chamber through said exhaust.

According to another aspect of the present invention, there is provided a thermal spray gun comprising:

at least one nozzle substantially as set out above;

fuel supply means for supplying fuel to at least one said fuel inlet; and coating material supply means for supplying coating material to said coating material inlet.

In a preferred embodiment, the spray gun is a high velocity oxygen fuel spray gun.

According to a further aspect of the present invention, there is provided a method of applying a coating material on an object, comprising the steps of:

introducing at least one fuel into a combustion chamber of a nozzle of a thermal spray gun and combusting said fuel to produce combustion gases that form a stream of gases within said combustion chamber towards an exhaust;

diverging said stream around at least one diverging device thereby creating a plurality of streams into a plurality of streams or an annular stream before converging said streams to a single stream;

introducing at least one coating material into said stream and spraying said material onto an object.

In a preferred embodiment, the at least one coating material is introduced into said streams in the space between a plurality of diverged streams or in the centre of the annular stream.

In another preferred embodiment, the fuel is oxygen and at least one fluid fuel.

BRIEF DESCRIPTION OF THE DRAWING FIGURES

Preferred embodiments of the present invention will now be described, by way of example only, and not in any limitative sense, with reference to the accompanying drawings in which.

DETAILED DESCRIPTION OF THE INVENTION

Figure 1:
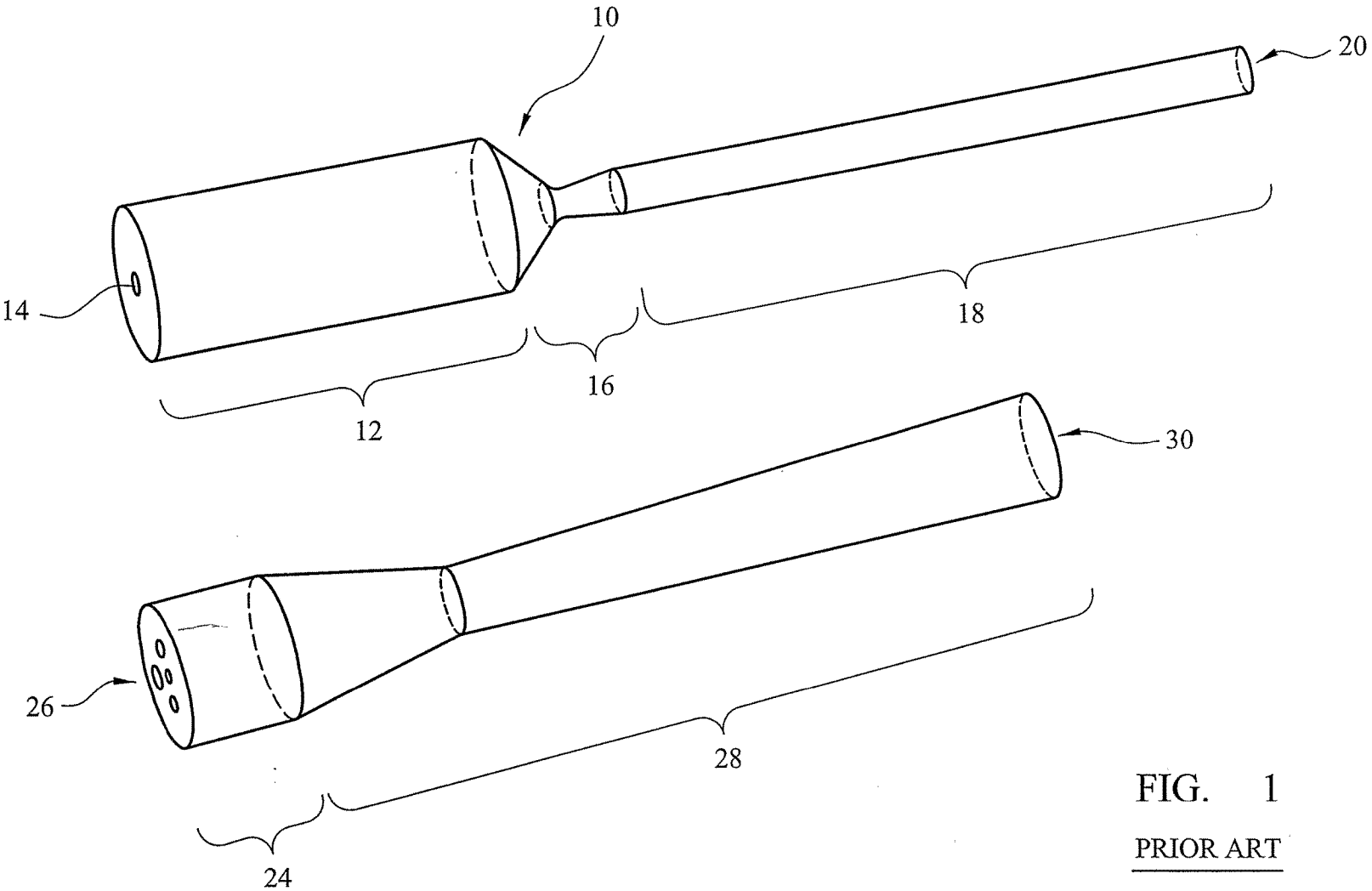
FIG. 1 PRIOR ART
FIG. 1 is a perspective view of two nozzles of the prior art.
Figure 2:
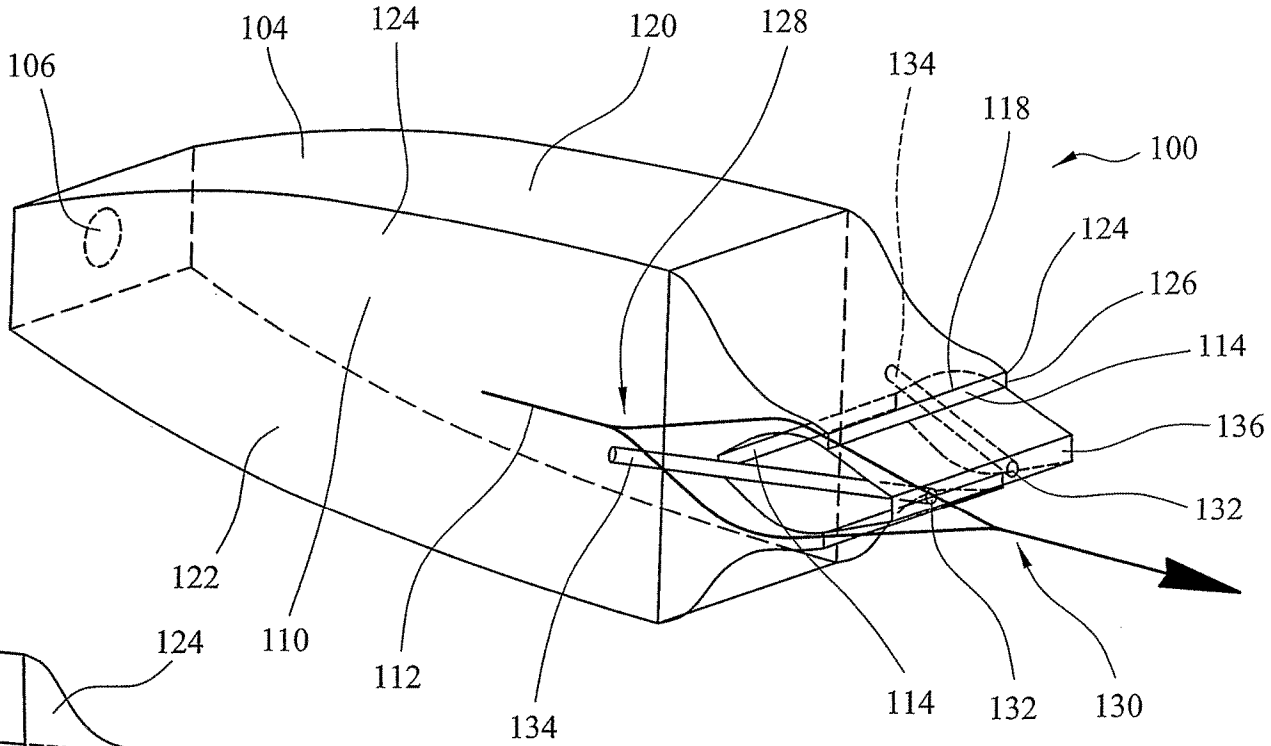
FIG. 2 is a perspective cut-away view of a nozzle of the present invention.
Figure 3:
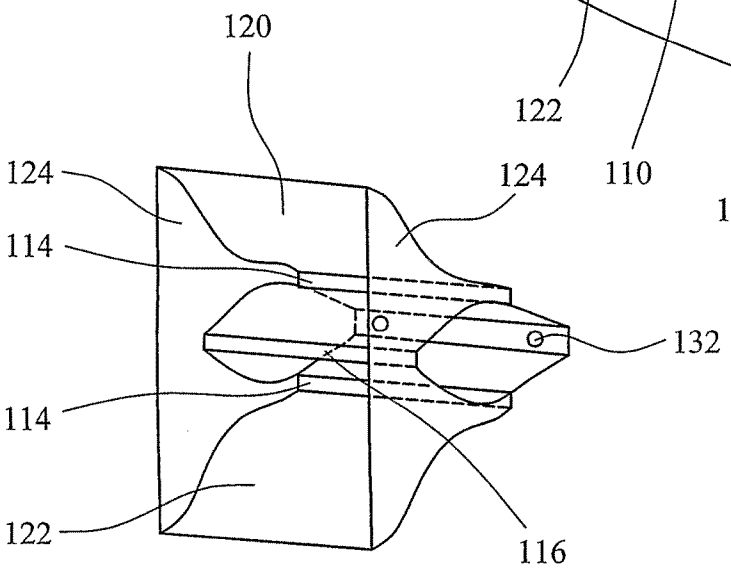
FIG. 3 is a perspective cut-away view of a front portion of the nozzle of FIG. 2.
Figure 4:
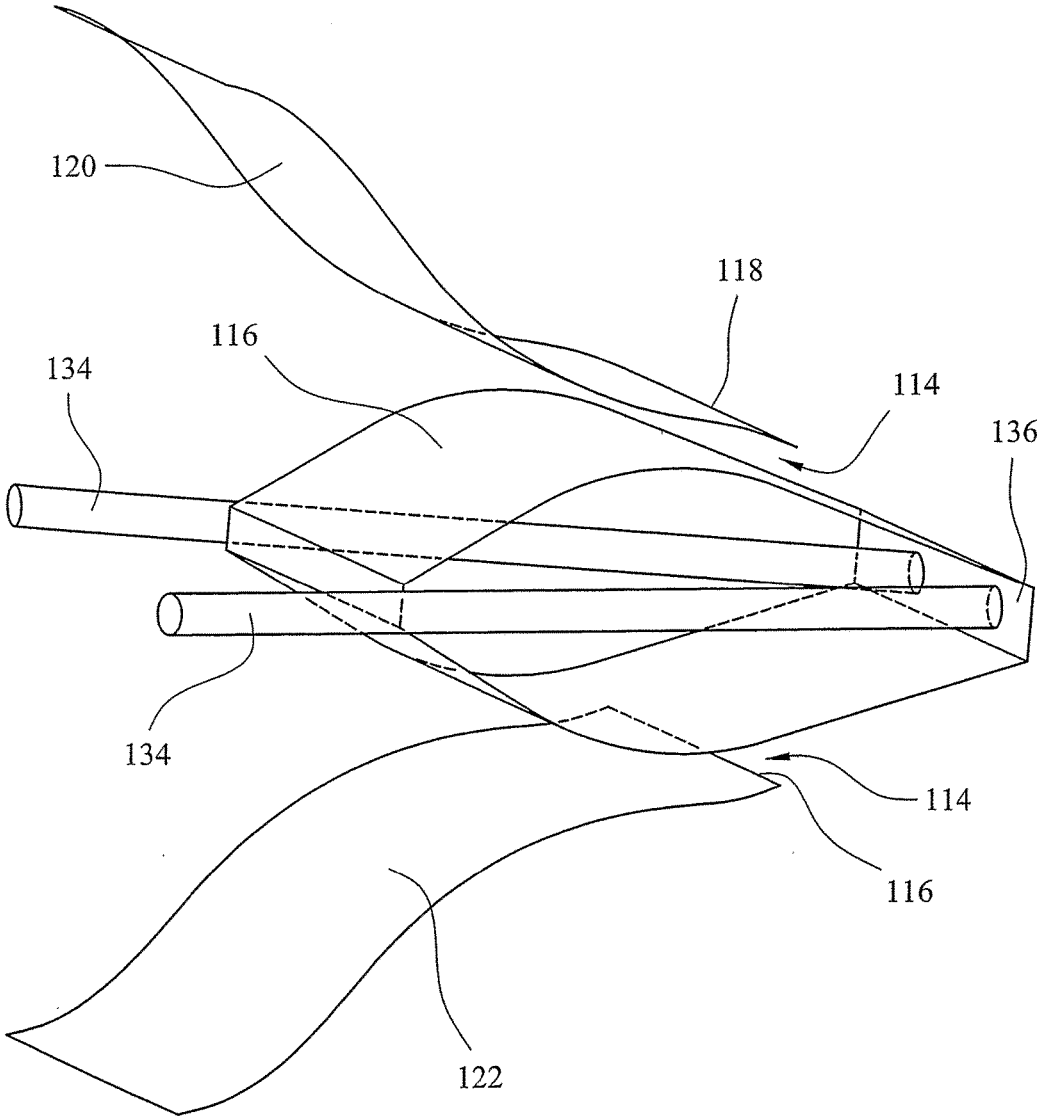
FIG. 4 is a schematic representation of the front portion of the nozzle of FIG. 3.
Figure 5:
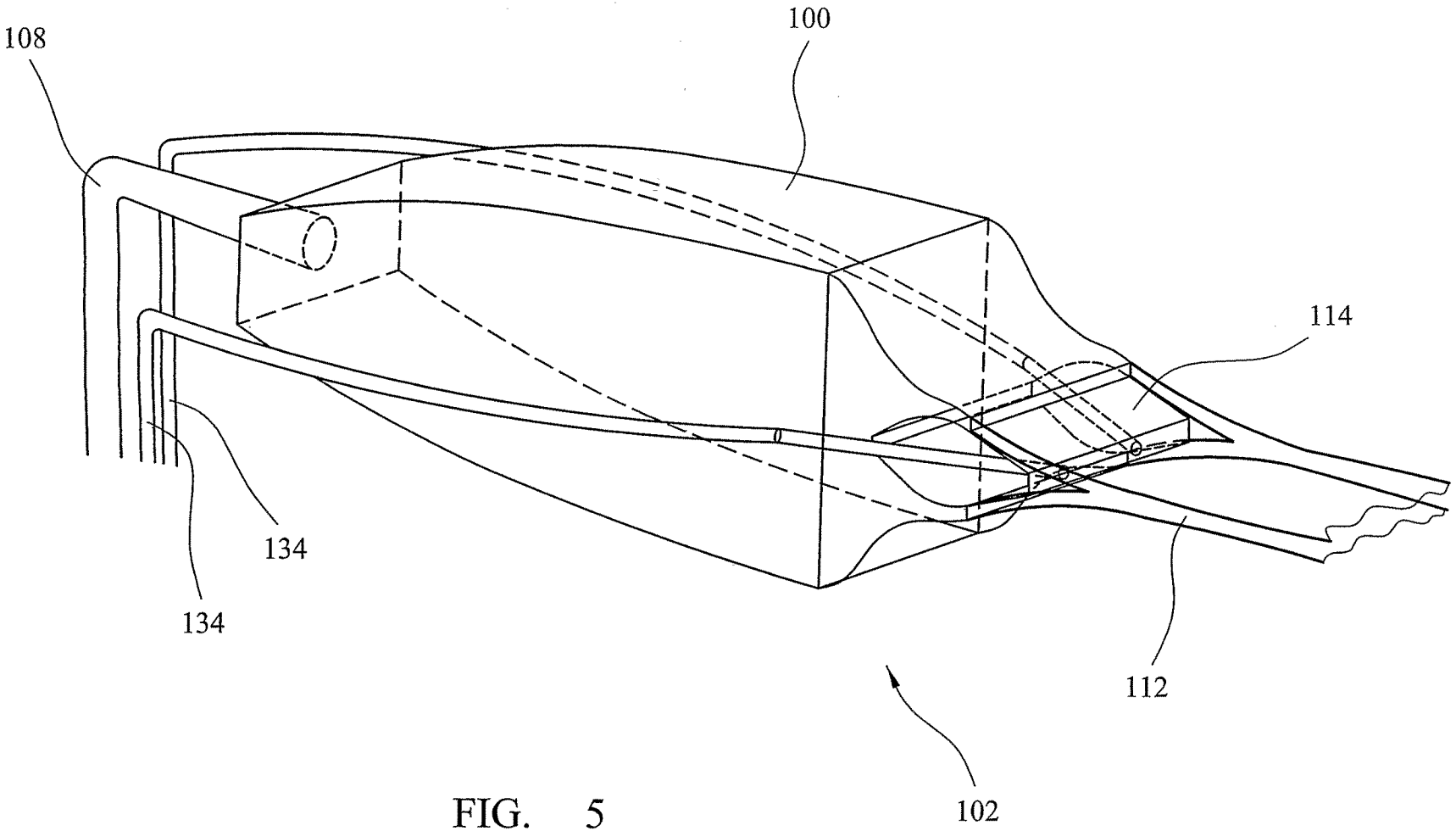
FIG. 5 is a schematic representation of a spray gun of the present invention.

Referring to FIGS. 2 to 5, a nozzle 100 for a thermal spray gun 102 has a combustion chamber 104. An inlet 106 introduces fuel into the combustion chamber from a fuel supply pipe 108. The fuel is burnt in a combustion zone 110 and a stream of combustion gases that leave the combustion chamber 104 through exhausts 114. The nozzle 100 also includes diverging means, in the form of aerospike 116, that is located partially within the combustion chamber. The aerospike 116, in combination with edges 118 of the curved top and bottom walls 120 and 122 and side walls 124 with edge 126, form exhausts 114. It should be noted that the side wall, opposing the side wall 124 shown in FIG. 2, is not illustrated in either FIG. 2 or FIG. 5, but is partially present in FIG. 3.

The presence of the aerospike 116 between exhausts 114 causes the stream 112 of combustion gases to diverge, as indicated at 128, and to converge as indicated at 130.

The nozzle 100 also has coating material inlets 132 in the form of apertures at the end of coating material feed pipes 134. The inlets 132 are preferably located in the most downstream edge 136 of aerospike 116 and on a short planar surface that is normal to the direction of stream 112.

The operation of thermal spray gun 102 will now be described with continuing reference to FIGS. 2 to 5. Fuel is pumped into combustion chamber 104 of thermal spray gun 102 through fuel inlet 106 from fuel supply pipe 108. A typical fuel is a mixture of gaseous fuel, for example propane, and oxygen. The fuel is supplied at a rate of 68 l/min, with oxygen supplied at a rate off 220 l/min. This propane and oxygen are mixed with air (flowing at 471 l/min) and a carrier gas, for example nitrogen or argon flowing at a rate of 14.5 l/min. However, this nozzle could also be used with other fuels including, but not limited to, Kerosene, Propane, Propylene and Hydrogen. Where a liquid fuel, such as Kerosene, is used an atomiser is required to ensure efficient combustion, although this increases the length of the nozzle. In the case of propane, the fuel is ignited with a spark at the front of the nozzle, outside the main body of the gun. Initially the mixture flow rate is set very low so that the mixture ignites outside of the body of the gun and the flame moves backwards in the chamber. By increasing the flow rate slowly and in small increments, the turbulent flame stabilizes within the chamber. For liquid fuels such as kerosene, a spark ignition system from inside the chamber is required.

Combustion takes place within the combustion zone 110 and a stream of high pressure, typically over 5 bar, and high temperature, typically 3300K, combustion gases are produced. The high pressure combustion gas stream 112 must exit the combustion chamber through exhausts 114 and in doing so, the stream is diverged into a pair of streams by the aerospike 116. The aerospike 116 forms one side of a virtual bell that is a conical shape (with at least 2 points of inflection) of the pair of diverged streams forming the aerospike, with the other side formed by the outside air. The upper and lower curved surfaces of the wedge-shaped aerospike 116 cause the two streams to converge, as indicated at 130.

At the point of convergence, the coating material, for example powdered Tungsten Carbide Cobalt, is added to the converging gas stream 112, at a rate of 50 g/min. At the point of powder injection, the gas temperature is around 1500K and the axial velocity of the gas is around 30 m/s. This rapidly increases to 2500K and 1700 m/s respectively before the powder particle impacts the surface being coated. However, the dwell time of the particle in the gas stream is sufficient to allow smooth and better particle heating than seen in the prior art.

The linear exhausts 114 are narrow elongate apertures in the combustion chamber and result from a linear aerospike being used. This shape of aperture has the advantage of producing an elongate coating spray. As a result, coating material is applied to the surface very efficiently and evenly in a spraying stroke similar to using a wide paint brush. However, other shapes of aerospike are equally applicable to this type of nozzle. When the nozzle shown in the figures is cut in a cross-section running normal to the axial flow of gases indicated by arrow 112, the cut edges form a series of rectangles. An annular aerospike engine could also be used in which the same cross-section would produce a series of circular edges. In this case, the exhaust would be a single circular annular exhaust extending around a centrally located aerospike. Furthermore, non circular annular aerospikes, such as squares, ovals or rectangles, could be used.

It will be appreciated by person skilled in the art that the above embodiments have been described by way of example only and not in any limitative sense, and that various alterations and modification are possible without departure from the scope of protection which is define by the appended claims. For example, the coating material used could be in a form other than a powder, such a wire being fed into the flame and the coating being melted from the wire. Furthermore, the nozzle of the present invention can be used in other thermal spray techniques in which gas acceleration is required, such as flame, arc, plasma or even cold spray.

Figure 6:
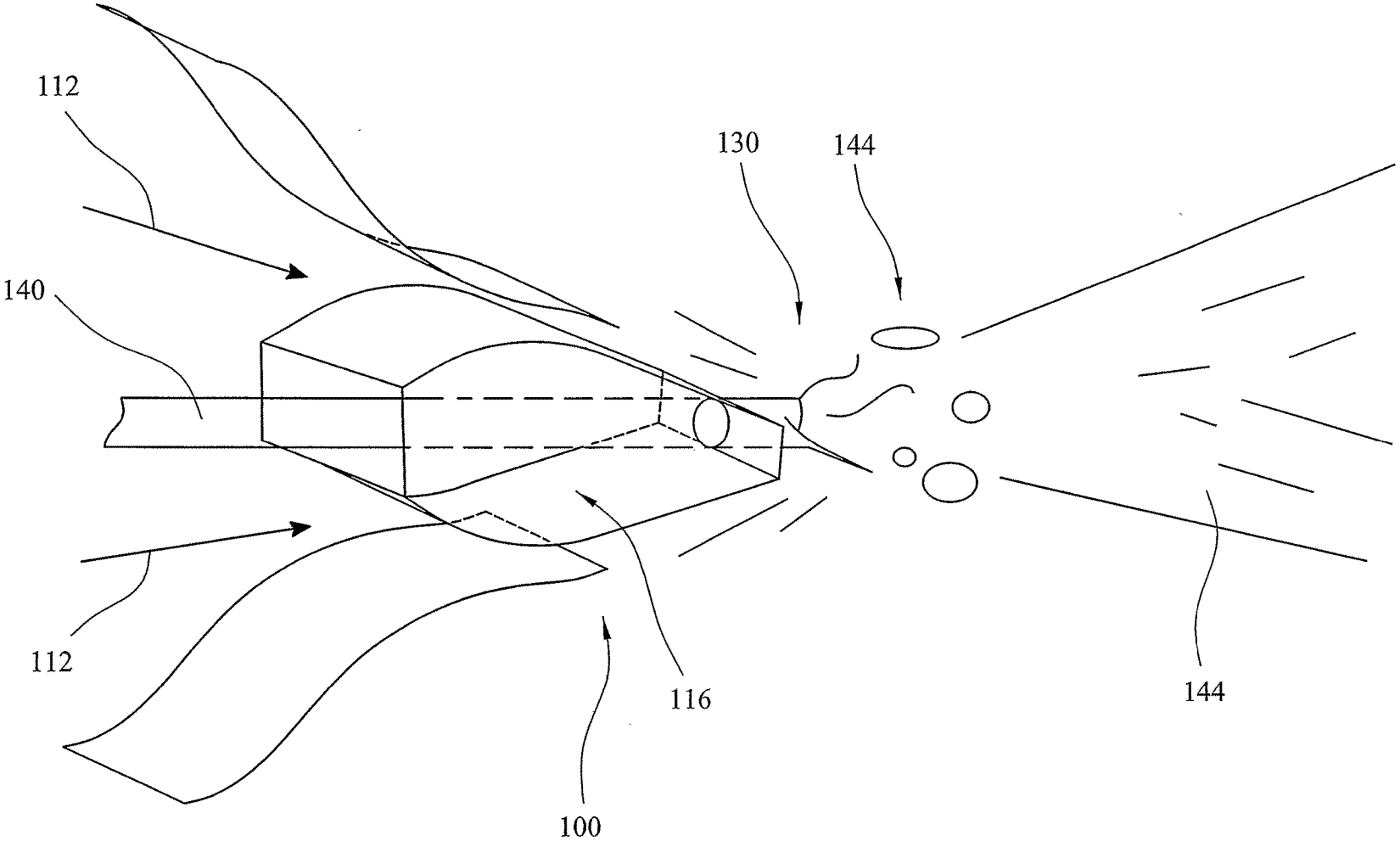
FIG. 6 is a schematic representation of the front portion of a nozzle of another embodiment of the present invention.

For example, FIG. 6 shows a nozzle 100 adapted for use in a wire flame spray gun. In this example a wire 140 is fed through a heated ceramic aerospike 116 into the converging gas streams 112 at 130 where it is atomized in an atomizing zone 142. The resulting spray 144 impacts on a surface to be coated (not shown).

Figure 7:
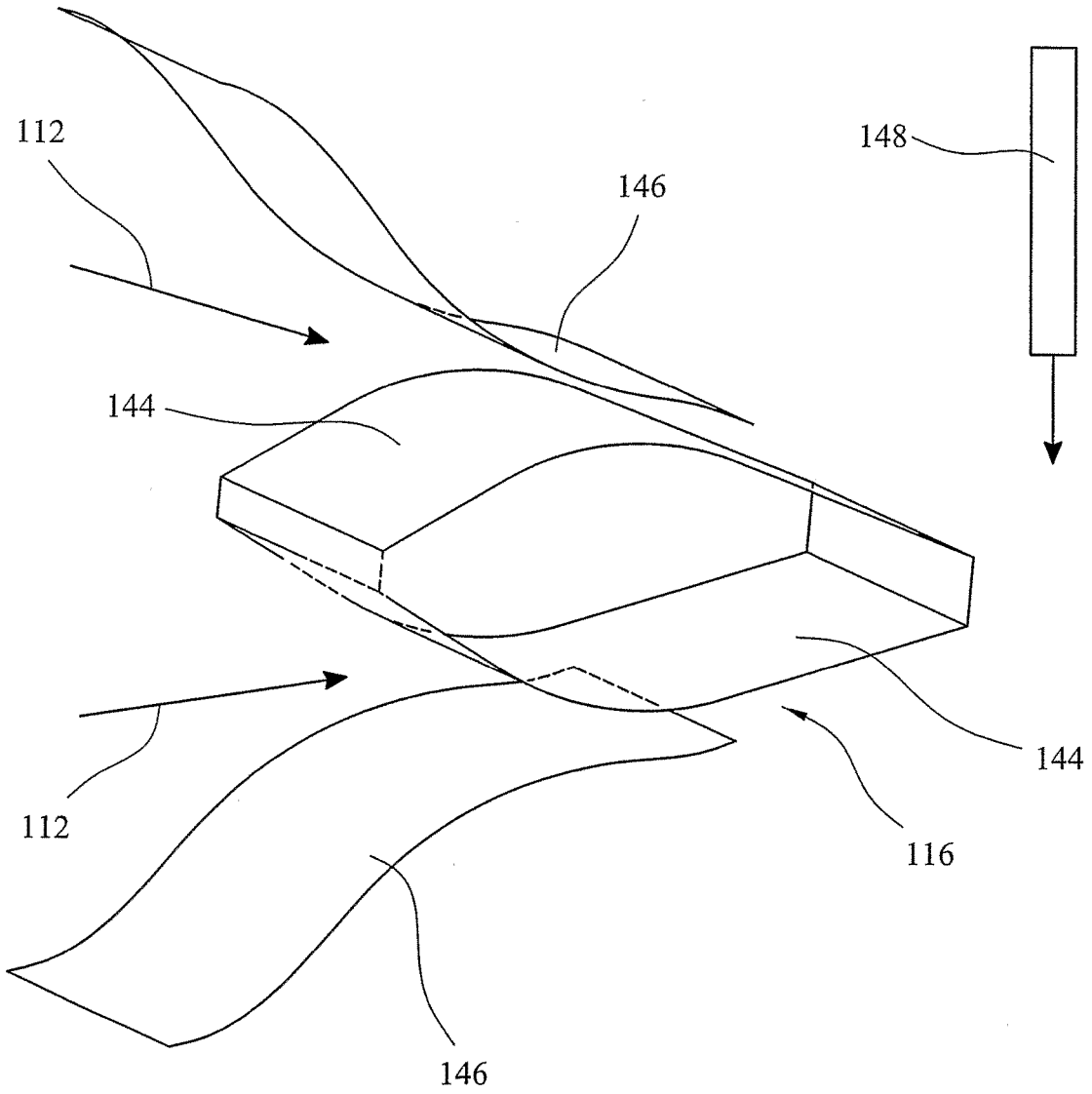
FIG. 7 is a schematic representation of the front portion of a nozzle of a further embodiment of the present invention.
Figure 8:
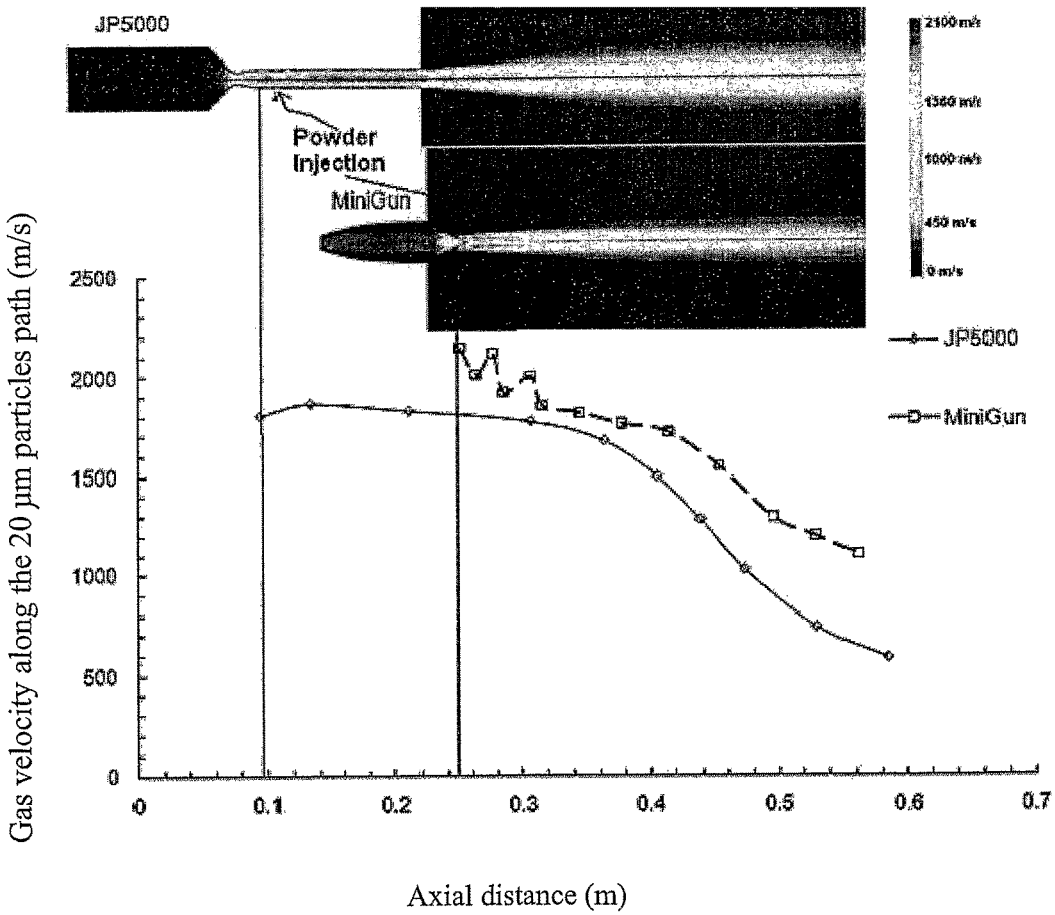
FIG. 8 is a graph showing a comparison between the gas velocity flow fields of the present invention and an example of the prior art.
Figure 9:
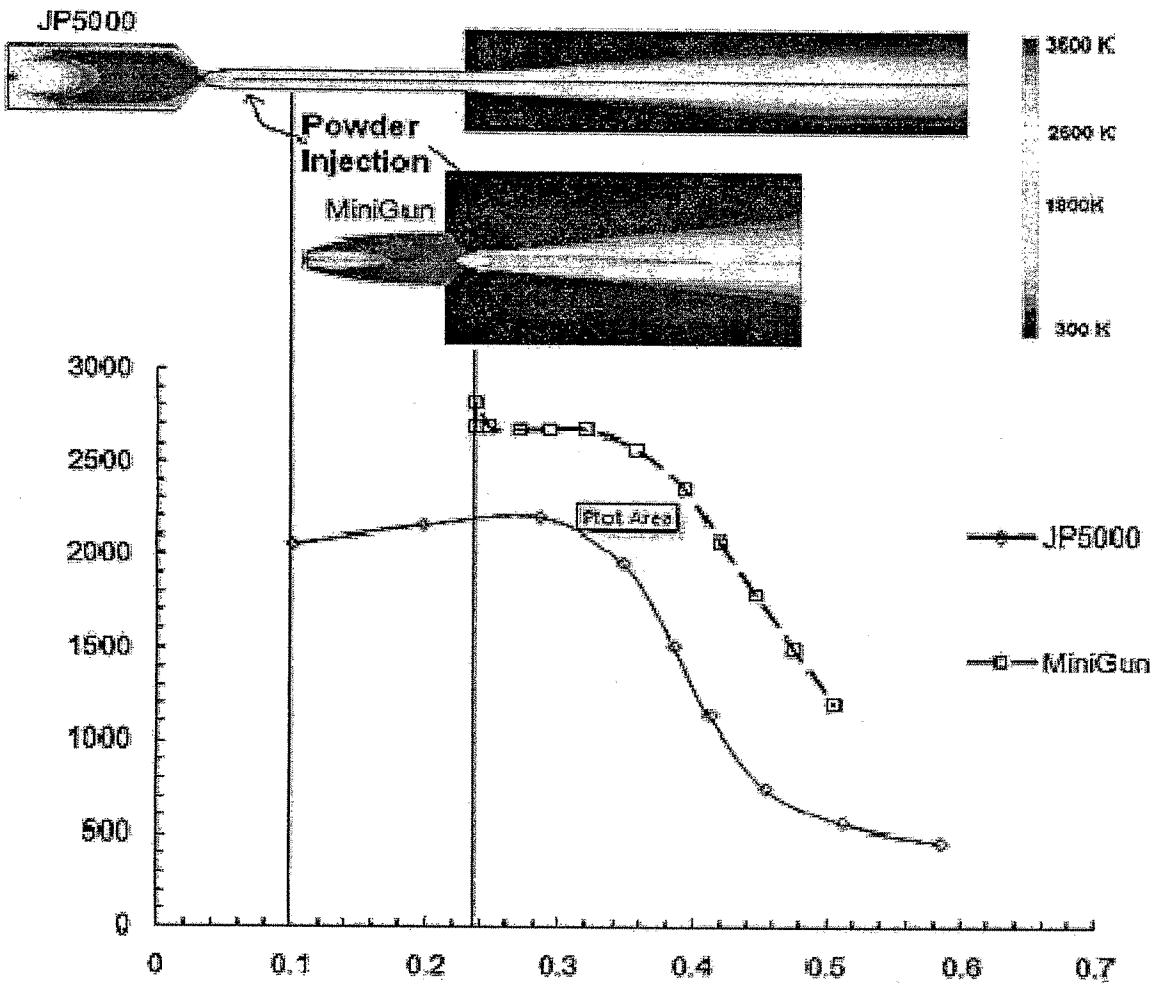
FIG. 9 is a graph showing a comparison between the temperature flow fields of the present invention and an example of the prior art.
Figure 10:
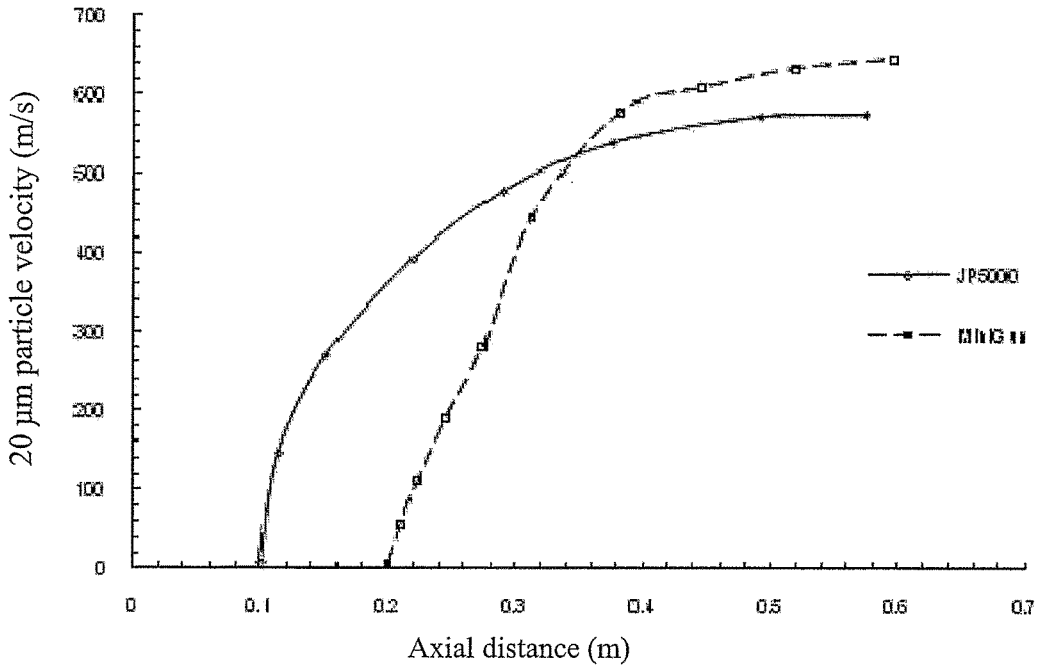
FIG. 10 is a graph showing the particle velocity comparison between the present invention and an example of the prior art.

In a further example, FIG. 7 shows a nozzle 100 adapted for use as a plasma gun. Arc gas passes through the nozzle in streams 112 with the aerospike 116 forming a pair of tungsten cathodes 144 and the surfaces 146 of top and bottom walls 120 and 122 which form water cooled anodes. Powder is introduced into the converging gas stream through inlet pipe 148.

The nozzle of the present invention can also be used in cold spraying. In this case the Oxy-Fuel burning gases are replaced with typical cold spray gases such as helium or nitrogen carrier gases used at higher flow rates.

Set out below, with reference to FIGS. 8 to 14, are examples of a modelled analysis of the performance of the embodiment of the present invention shown in FIGS. 2 to 5, when compared with an example of the prior art. The nozzle of the present invention generates a stable supersonic jet which is powerfully directed towards the spraying line.

Comparing with an example of the prior art, which uses a converging diverging nozzle (CDN), the nozzle of the present invention reaches higher axial velocity (see FIG. 8) which is maintained longer than in the prior art. This increase in velocity is as a result of the delayed mixing of the jet core with ambient air due to narrower jet spread. Although the results clearly demonstrate that the nozzle of the present invention generates a more powerful and axially confined jet under same operating conditions as the prior art (for example, same oxy-fuel mixture mass flow rate), it is not possible to completely eliminate the trailing shocks, which are due to the truncated nozzle body. It must be noted that the higher values of velocity are not on the nozzle front base but at a certain distance from it. The short low velocity region works in favour of powder heating. In particular, the dwell time for the particle is increased while temperature build up is apparent.

A comparison between gas temperature for the nozzle of the present invention and the prior art (FIG. 9) clearly demonstrates the ability of the present invention to generate higher temperature flow field. The reason of such a big temperature difference between the nozzle of the present invention and the prior art lies on the fact that, in the prior art, the static temperature drops when gas is compressed and then expands several times throughout the process. In the prior art the gas compresses and accelerates in the exit to the converging diverging nozzle and along the barrel with a direct decrease in gas temperature of over 1000K. Then the flow again expands in the barrel exit where the temperature drops further. In contrast, the nozzle of the present invention is designed in such a way that the flow expands just once at the nozzle tip. The top and bottom jet streams, which are merged downstream, deliver enough energy through convection and radiation for heating up the powder at the desired level. Furthermore, the nozzle of the present invention prevents direct contact between the powder and the flame eliminating the undesirable reactions on the powder's surface. The gas temperature flow field generated by the nozzle of the present invention has a configuration that is ideal for low surface reaction particle heating.

The improvements in gas flow characteristics are reflected in particle heating and acceleration. The powder material used for the simulation is Tungsten-Cobalt Carbide (WC-12Co). The nozzle of the present invention is designed in such a way that the aerospike provide a robust configuration for delivering maximum kinetic and thermal energy to the powder by reducing the aerodynamic loses and consequently loses to deliverable energy. The simulations show in FIGS. 10 and 11 that both critical parameters of velocity and temperature are well above those possible in the prior art. For 20 μm particles the surface temperature reaches the value of 1200K and the velocity 650 m/s. At this higher temperature, material softening starts to take place and combined with the higher kinetic energy increases in deposition rate and coating quality are expected. The typical powder size that is currently used from industry with the prior art does not fall below 10 μm. The reason is that powder material disperses in the gas field and consequently rebounds or never reaches the substrate.

Figure 11:
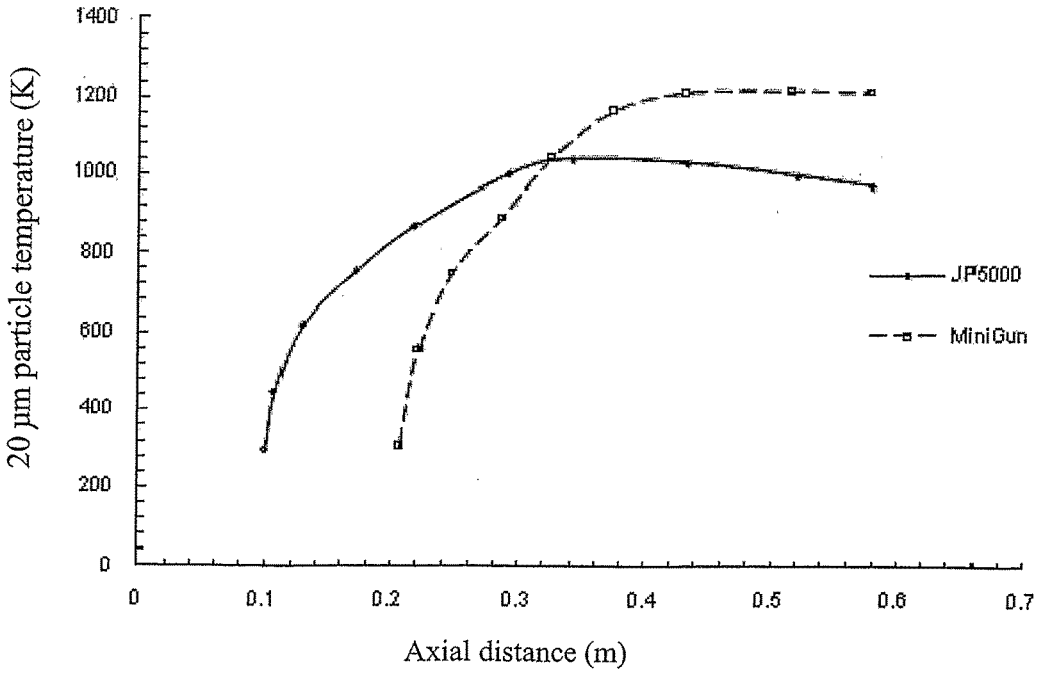
FIG. 11 is a graph showing the particle temperature comparison between the present invention and an example of the prior art.
Figure 12:
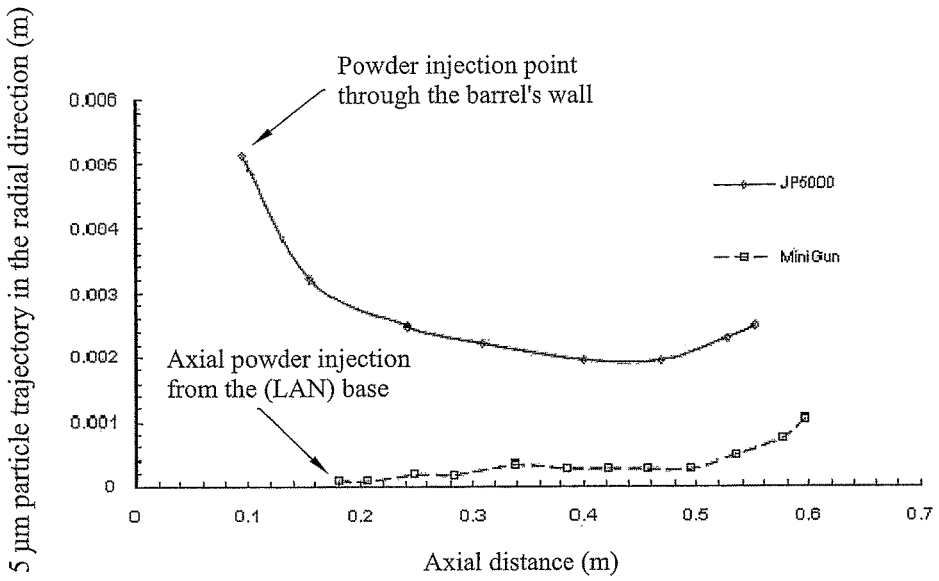
FIG. 12 is a graph showing the particle path-line in 2D comparing the present invention and an example of the prior art.
Figure 13:
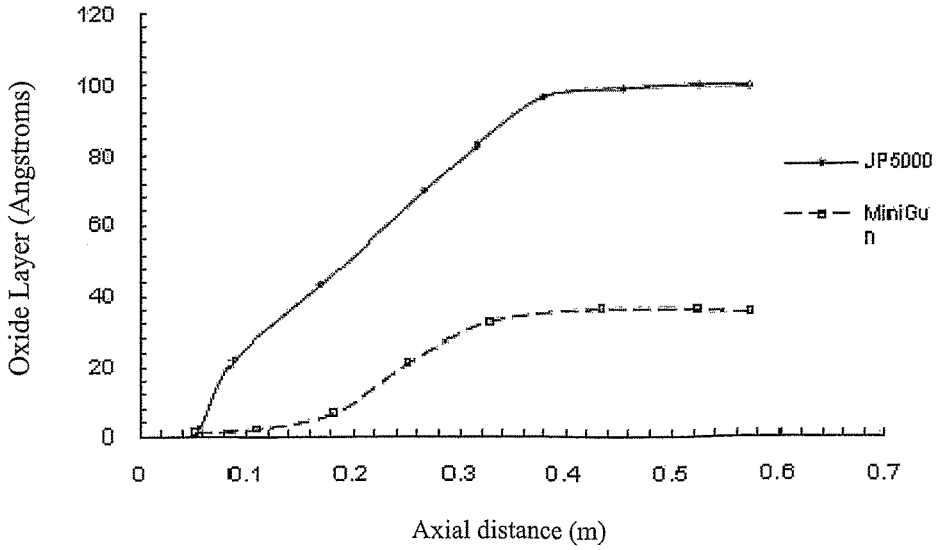
FIG. 13 is a graph showing the surface oxidation comparison between the present invention and an example of the prior art.

In FIG. 11, the particle path-line in the radial direction is shown. Small particles (5 μm in diameter) never reach the flow centreline for the prior art configuration. This means that they cannot benefit from the high velocity-temperature flow regions and instead follow a route on the border of the free jet. When the turbulent mixing with ambient air starts to grow the flow diffuse in all directions. The lightweight particles chase the flow direction and consequently are blown away from the substrate. However, the nozzle of the present invention is designed in such a way that makes it even more appropriate for spraying small particles. The aerospike nozzle design allows for an axial powder injection for which particle dispersion is limited as shown in FIG. 12. The resultant particle velocity vector in a radial direction is considerably smaller than in the prior art therefore spraying location on the substrate can be precisely controlled.

Figure 14:
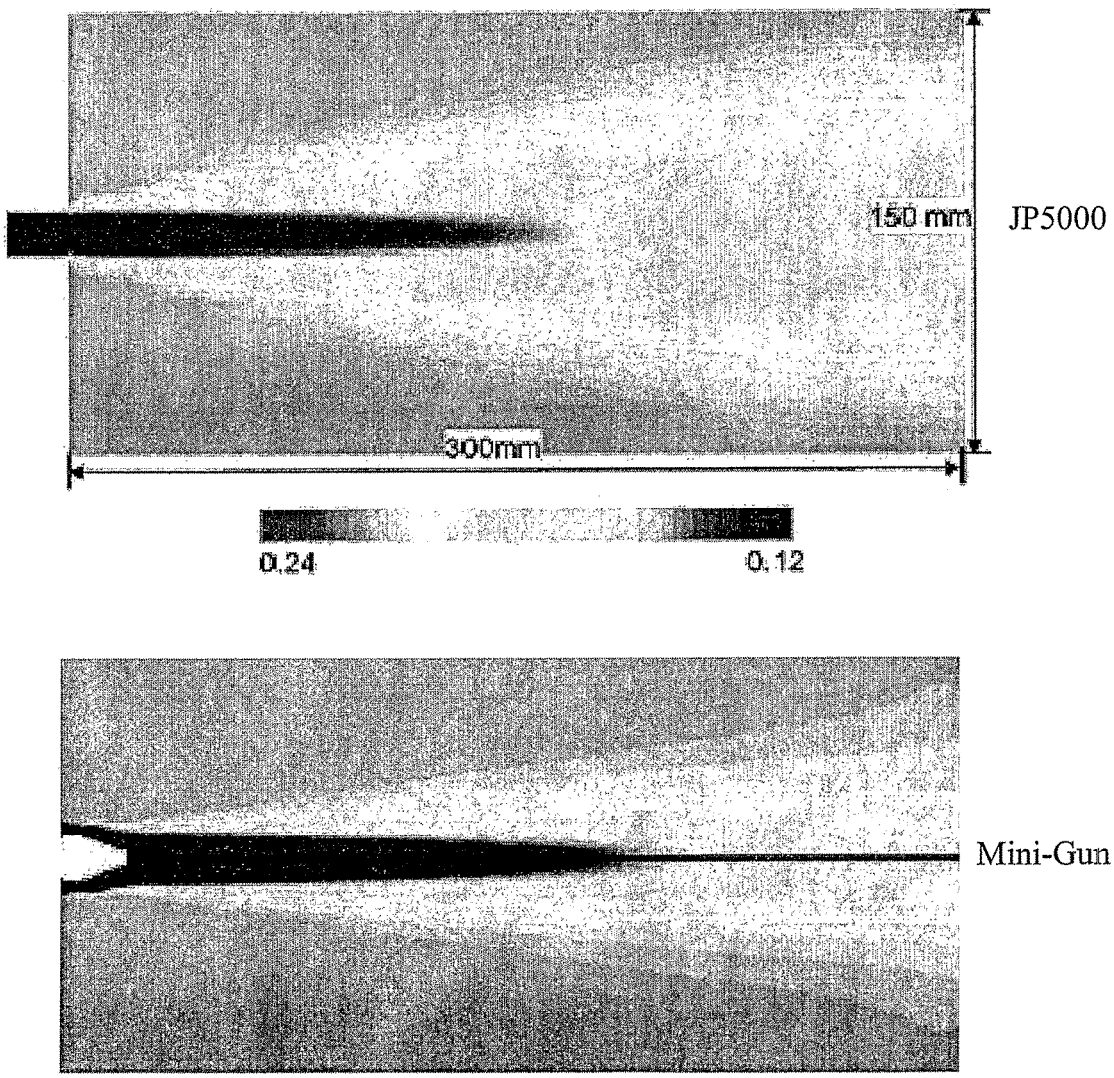
FIG. 14 an Oxygen mole fraction contour plot of the external domain comparing the present invention and an example of the prior art.

The high thermal profiles endured for sprayed particles give rise to oxidation on the surface of powders which has been found in as-sprayed metallic coating using microscopic image techniques. Metallic oxides are brittle and have different thermal expansion coefficients in comparison to the surrounding metals. Therefore, the oxides in the coating have a negative effect on the mechanical properties of coating, which undermines the performance of coated products. This gives rise to the importance of reducing the development of oxides during thermal spraying in order to achieve higher quality coatings. Oxidation on the particle surface will take place when enough oxygen is available in the surrounding gas flow. Based on the Mott-Cabrera theory, oxidation is controlled by the ion transport through the oxide film and therefore the growth of the oxide layer can be limited by decreasing the oxygen fraction that surrounds the particle. The oxygen mole fraction increases in the jet when mixing with ambient air occurs. The oxygen contour plot in FIG. 14 shows the supersonic gas jet generated by the nozzle of the present invention can protect more than in the prior art where excessive oxygen to penetrate into the jet core. As a result, in the present invention a very small amount of oxygen is available and less oxidation is expected. The oxide film thickness is 5 times less than is created from the prior art.

What is claimed is:

1. A high velocity oxygen fuel thermal spray gun, comprising:

a nozzle having a combustion chamber having a fuel inlet receiving fuel, the combustion chamber having a combustion zone within which combustion of the fuel takes place to produce a stream of combustion gases;

an exhaust for exhausting the stream of combustion gases from the combustion chamber; and a diverging device located partially within the combustion chamber and through the exhaust, and having an external portion of the diverging device, the external portion being located both outside the combustion chamber and outside the exhaust, the diverting device being configured to create a divergence in the stream of combustion gases thereby creating a plurality of streams before converging to a single stream downstream of the diverging device, the diverging device having a coating material inlet introducing a coating material into the stream of the combustion gases at a point of the diverging device that is outside of the combustion chamber.

2. The spray gun according to claim 1, wherein the exhaust comprises a plurality of substantially rectangular apertures extending between the combustion chamber and the diverging device, the apertures having a rectangular cross section in a direction substantially perpendicular to a direction of flow of the stream of combustion gases leaving the exhaust.

3. The spray gun according to claim 2, wherein the cross section is a rectangle.

4. The spray gun according to claim 3, further comprising at least one oxygen supply feed configured for supplying oxygen to the fuel inlet.

5. The spray gun according to claim 2, wherein the plurality of apertures includes a first aperture on a first side of the diverging device and a second aperture on a second side of the diverging device, the second side being opposite the first side.

6. The spray gun according to claim 5, wherein the first and second apertures are on opposite sides of the coating material inlet.

7. The spray gun according to claim 1, further comprising a fuel supply feed for supplying the fuel to the fuel inlet; and a coating material supply feed for supplying the coating material to the coating material inlet.

8. A method of applying a coating material on an object using a high velocity oxygen fuel thermal spray gun, the method comprising:

introducing a fuel into a combustion chamber of a nozzle of the high velocity oxygen fuel thermal spray gun and combusting the fuel to produce combustion gases that form a stream of gases within the combustion chamber, the stream of gases being directed toward an exhaust;

diverging the stream of gases around a diverging device located partially within the combustion chamber and through the exhaust, and having an external portion of the diverging device, the external portion being located both outside the combustion chamber and outside the exhaust, thereby creating a plurality of streams before converging the plurality of streams to a single stream downstream of the diverging device, and introducing a coating material into the plurality of streams and spraying the coating material onto an object.

9. The method according to claim 8, wherein the coating material is introduced into a space between the plurality of streams.

10. The method according to claim 8, wherein the fuel is oxygen and a fluid fuel.

11. The method according to claim 8, wherein the exhaust comprises a plurality of substantially rectangular apertures extending between the combustion chamber and the diverging device, the apertures having a rectangular cross section in a direction substantially perpendicular to a direction of flow of the stream of combustion gases leaving the exhaust.

12. The method according to claim 11, wherein the cross section is a rectangle.

13. The method according to claim 11, wherein the plurality of apertures includes a first aperture on a first side of the diverging device and a second aperture on a second side of the diverging device, the second side being opposite the first side.

14. The method according to claim 13, wherein the first and second apertures are on opposite sides of the coating material inlet.

15. A nozzle for a high velocity oxygen fuel thermal spray gun, the nozzle comprising:

a combustion chamber having a fuel inlet receiving a fuel, the combustion chamber having a combustion zone within which combustion of the fuel takes place to produce a stream of combustion gases an exhaust for exhausting the stream of combustion gases from the combustion chamber; and a diverging device located partially within the combustion chamber and through the exhaust, and having an external portion of the diverging device, the external portion being located both outside the combustion chamber and outside the exhaust, the diverging device being configured to create a divergence in the stream of combustion gases thereby creating a plurality of streams before converging the plurality of streams into a single stream downstream of the diverging device, the diverging device having a coating material inlet introducing a coating material into the stream of the combustion gases at a point of the diverging device that is outside the combustion chamber.

16. The nozzle according to claim 15, wherein the exhaust comprises a plurality of substantially rectangular apertures extending between the combustion chamber and the diverging device, the apertures having a rectangular cross section in a direction substantially perpendicular to a direction of flow of the stream of combustion gases leaving the exhaust.

17. The nozzle according to claim 16, wherein the cross section is a rectangle.

18. The nozzle according to claim 16, wherein the plurality of apertures includes a first aperture on a first side of the diverging device and a second aperture on a second side of the diverging device, the second side being opposite the first side.

19. The nozzle according to claim 18, wherein the first and second apertures are on opposite sides of the coating material inlet.

* * * * *